US007728230B2

(12) United States Patent
Ma

(10) Patent No.: US 7,728,230 B2
(45) Date of Patent: Jun. 1, 2010

(54) COMPOUND AND HOLLOW INSULATOR AND ITS MANUFACTURING METHOD THEREOF

(75) Inventor: Bin Ma, Group1, Huzhuang Village, Gaonan Town, Rugao, Jiangsu Province, 226553 (CN)

(73) Assignee: Bin Ma, Jiangsu Province (CN)

( * ) Notice: Subject to any disclaimer, the term of this patent is extended or adjusted under 35 U.S.C. 154(b) by 846 days.

(21) Appl. No.: 10/570,994

(22) PCT Filed: Jun. 23, 2004

(86) PCT No.: PCT/CN2004/000672

§ 371 (c)(1),
(2), (4) Date: Oct. 18, 2006

(87) PCT Pub. No.: WO2005/024855

PCT Pub. Date: Mar. 17, 2005

(65) Prior Publication Data

US 2007/0251718 A1 Nov. 1, 2007

(30) Foreign Application Priority Data

Sep. 11, 2003 (CN) ..... 03 1 58222

(51) Int. Cl.
*H01B 17/00* (2006.01)

(52) U.S. Cl. ..... 174/137 R; 174/138 R; 174/155; 174/172; 174/178; 29/887

(58) Field of Classification Search ..... 174/137 R, 174/138 R, 155–156, 158 R, 172, 178, 179, 174/181, 194–195, 135, 110 R, 118, 212; 29/887

See application file for complete search history.

(56) References Cited

U.S. PATENT DOCUMENTS 1,899,757 A * 2/1933 Jansson ..... 174/167
2,809,259 A * 10/1957 Sucha et al. ..... 218/2

FOREIGN PATENT DOCUMENTS

| | | |
|---|---|---|
| CN | 2220696 Y | 2/1996 |
| CN | 2374951 Y | 4/2000 |
| DE | 231 679 A1 | 1/1986 |
| WO | 97/32318 | 9/1997 |

* cited by examiner

*Primary Examiner*—Dhiru R Patel
(74) *Attorney, Agent, or Firm*—Lowe Hauptman Ham & Berner LLP

(57) ABSTRACT

This invention involves a compound and hollow insulator and its manufacturing method thereof. The insulator includes a connector, an insulating tube and petticoat. The insulating tube is made by winding epoxy glass fiber. The petticoat is arranged outside the insulating tube. The connector is arranged at the two ends of the insulating tube. The petticoat becomes an integrated body through injecting silicon sulfide rubber at the high-temperature so that the electrical and mechanical property is better. Meanwhile, the ratio of the qualified products is improved.

13 Claims, 1 Drawing Sheet

COMPOUND AND HOLLOW INSULATOR AND ITS MANUFACTURING METHOD THEREOF

RELATED APPLICATIONS

The present application is based on International Application No. PCT/CN2004/000672 filed Jun. 23, 2004, and claims priority from, Chinese Application Number 03158222.2 filed Sep. 11, 2003, the disclosure of which is hereby incorporated by reference herein in its entirety.

TECHNICAL FIELD

This invention involves a compound and hollow insulator and its manufacturing method thereof. The insulator includes a connector, an insulating tube and petticoat. It is applied in HV power station of electric industry.

BACKGROUND OF THE INVENTION

Presently, power transmission and transformer equipment usually adopt porcelain hollow insulator. However, porcelain insulator is explosive with heavy weight and large volume. It is easy to be broken and requires regular cleaning up. This caused much inconvenience for installation and maintenance.

In order to overcome above insufficiencies of porcelain insulator, a compound and hollow insulator made of organic synthesis material appeared.

The current manufacturing technology mainly includes two: One is to use single petticoat mould for silicon sulfide rubber (RTV) at room temperature to cast petticoat body piece by piece on the special equipment; The other is to use liquid silicon rubber (LSR) and double-component injection pump to inject and form petticoat body at medium temperature (120° C). The shortcoming of these two technologies is that the resistance property for electric corrosion and aging of the product's external insulation are poor. Meanwhile, their technical and economical efficiency are also low.

The weather & aging resistance property and electric corrosion resistance property of high temperature silicon sulfide rubber are extremely good. However, since it is in solid state, high temperature and high pressure are needed for manufacturing. And the insulating tube of hollow insulator is hollow, which is extremely easy to be broken once bearing the pressure, especially under high temperature. Therefore, it has not been applied in manufacturing hollow insulator in HV power station.

SUMMARY OF THE INVENTION

This invention aims at providing a compound and hollow insulator, which is not easy to appear aging and/or chap in petticoat body even under the worst natural environment. Hence, its service life can be lengthened and maintenance workload can be reduced so as to guarantee the safety operation of electrical power system.

At the same time, this invention aims at providing a compound and hollow insulator manufacturing method to simplify and properly control the manufacturing process as well as improve the ratio of qualified products.

In order to solve above technical problems, this invention adopts following technical solution:

A compound and hollow insulator includes a connector, an insulating tube and petticoat. The insulating tube is a hollow one made by winding epoxy glass fiber. The connector is fixed at the two ends of the insulating tube. Outside the insulating tube is an integrated petticoat body. The petticoat material is high-temperature silicon sulfide rubber (HTV).

The compound and hollow insulator with above structure is manufactured by following methods: Make hollow insulating tube by winding epoxy glass fiber; Place the insulating tube processed into a mould cavity of petticoat body rubber injection machine; After the mould of injection machine is locked, the high-temperature silicon sulfide rubber is injected into the mould cavity through rubber injection machine; Then, petticoat body integrated with insulating tube is formed after sulfuration (Temperature is controlled within 150° C.~190° C.); Use adhesive to stick the connector onto the two ends of the insulating tube.

The rubber injection machine in this manufacturing method has heating and pressurization device as well as corresponding monitoring and control system.

Compared with prior art, the compound and hollow insulator manufactured with the method in this invention has obviously following advantages:

1. Compared with compound and hollow insulator integrated by adhesive between the petticoat currently: This compound insulator petticoat is an integrated body without any bonding surface. There is not any possibility of cracks and thus the structural strength and insulation property are improved;
2. The petticoat body and insulating tube are bonded into an integrity in this way: the high-temperature silicon sulfide rubber, which will become petticoat body, is heated to a fluid state, injected into the petticoat body mould cavity and evenly surrounds the insulating tube. After cooling and solidification, an integrity is formed. Compared with current bonding technology, the structural strength of this compound and hollow insulator is more reliable.
3. Since the heating temperature of high-temperature silicon sulfide rubber is controlled within 150° C.~190° C. during the rubber injection process, the petticoat internal structure after sulfuration becomes more even and petticoat cracks due to uneven stress can be avoided.
4. Compared with compound and hollow insulator made of silicon sulfide rubber (RTV) at room temperature: the weather & aging resistance property and electric corrosion resistance property are improved. Its service life is lengthened, material cost is low and manufacturing efficiency is high.
5. The manufacturing process of this product is simple and can be easily controlled. The ratio of qualified products is extremely high.

BRIEF DESCRIPTION OF THE DRAWING

See following drawing for detailed embodiment process of this invention.

DETAILED DESCRIPTION OF THE PREFERRED EMBODIMENT

Figure 1:
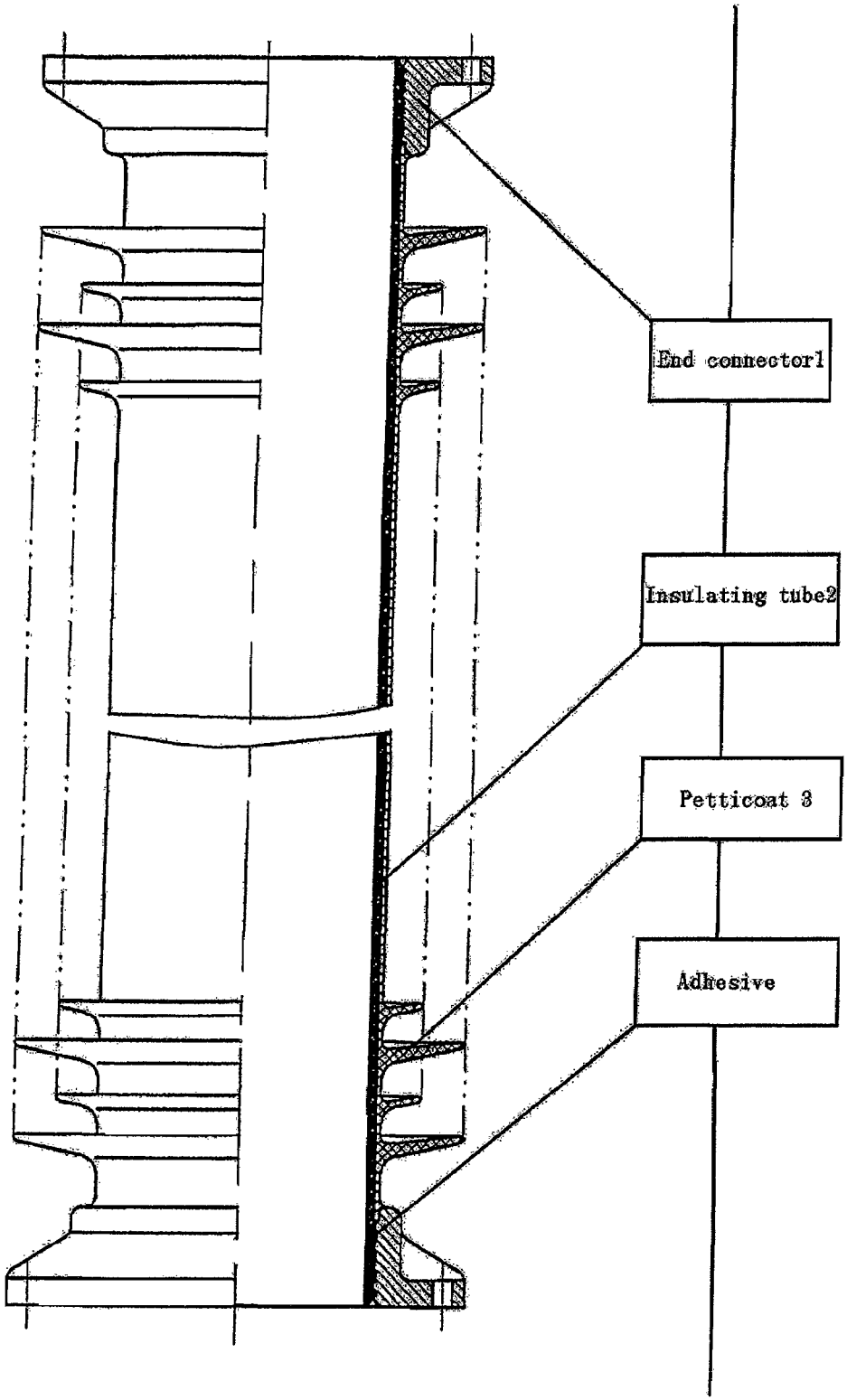
FIG. 1 is Half-section Structural Sketch of Compound and Hollow Insulator of This Invention.

Refer to attached drawing. The compound and hollow insulator of this invention consists of connector 1, insulating tube 2 and petticoat 3. The insulating tube is a hollow one made by winding epoxy glass fiber. The petticoat 3 is arranged outside the insulating tube 2 and becomes an integrated body through injecting silicon sulfide rubber at the high-temperature (HTV). The connector 1 is fixed at the two ends of the insulating tube.

Petticoat material can be the high-temperature silicon sulfide rubber containing methyl ethenyl silicon rubber (20%~50%), white carbon black (20%~60%), aluminum hydroxide (25%~50%), silicone oil (2%~5%) and vulcanizing agent (1%).

The sulfuration process may be conducted based on product material and sizes in respective 150° C.~190° C. temperature and 20-60 min duration. The appropriate sulfuration process has greatly improved the product's electrical and mechanical property as well as aging resistance property.

On the basis of conventional rubber injection machine, the rubber injection machine in this invention is equipped with heating and temperature control device as well as pressurization and pressure control device in order to better control the product quality and improve the qualified product ratio. After Mould Lock, the mould is maintained in a certain temperature range. Meanwhile, following parameters obtained from large numbers of tests can be accurately detected and controlled: mould temperature: 150° C.~190° C., Mould Lock pressure: 500 t~3000 t, rubber injection pressure: 1200~1800 bar (MPa).

This invention adopts the following manufacturing process:

Step one, Make hollow insulating tube 2 by winding epoxy glass fiber,

Step two, Put the insulating tube 2 in petticoat mould which is placed in rubber injection machine; Then, close the mould;

Step three, Apply a certain pressure onto rubber injection machine and lock the mould, so called "Mould Lock";

Step four, The injection machine starts to inject the rubber. The integrated petticoat is outside the hollow insulating tube 2;

Step five, Conduct sulfuration; The temperature is controlled within 150° C.~190° C.; Keep for 20-60 min.;

Step six, Open the mould to take down the insulator; Perform correction and edge trimming. Then, stick the connector onto the two ends of the hollow insulating tube 2.

Meanwhile, the rubber injection machine in this invention is also equipped with a cold flow passage device to ensure no rubber burning occurs in the rubber injection process. Moreover, a mould vacuumizing device is also available to vacuumize the mould after Mould lock so as to avoid air bubbles in the injection process.

The rubber injection machine stated in this invention also has an inner core positioning device which is used to fix the inner core closely related to insulating tube 2. This inner core is made with steel pipe. It can evenly transmit heat and pressure and improve the bearing capacity of hollow insulating tube 2.

In order to properly control the bearing condition of insulating tube 2, the injection machine may be arranged in a way to perform multi-spot injection. The injection spots are uniformly distributed as per multiples of two or three around the mould.

MANUFACTURING EXAMPLE 1

Petticoat material: High temperature silicon sulfide rubber, which includes: methyl ethenyl silicon rubber 25%, white carbon black 32%, aluminum hydroxide 40%, silicone oil 2%, vulcanizing agent 1%.

Process:

Step one, Make hollow insulating tube 2 by winding epoxy glass fiber,

Step two, Put the insulating tube 2 in petticoat mould which is placed in rubber injection machine; Then, close the mould;

Step three, Apply a certain pressure 2000 t onto rubber injection machine and lock the mould, so called "Mould Lock";

Step four, The injection machine starts to inject the rubber. The rubber injection pressure is 1200 bar. The integrated petticoat is outside the hollow insulating tube 2;

Step five, Conduct sulfuration; The temperature is controlled within 170° C.±10° C.; Keep for 45 min;

Step six, Open the mould to take down the insulator; After correction, stick the connector onto the two ends of the hollow insulating tube 2.

MANUFACTURING EXAMPLE 2

Petticoat material: methyl ethenyl silicon rubber 40%, white carbon black 20%, aluminum hydroxide 35%, silicone oil 4%, vulcanizing agent 1%.

Step one, Make hollow insulating tube 2 by winding epoxy glass fiber,

Step two, Evenly apply a layer of adhesive on the external surface of insulating tube 2. Then, put it in petticoat mould which is placed in rubber injection machine; Close the mould;

Step three, Apply a certain pressure 600 t onto rubber injection machine and lock the mould, so called "Mould Lock";

Step four, The injection machine starts to inject the rubber. The rubber injection pressure is 1500 bar. The integrated petticoat is outside the hollow insulating tube 2;

Step five, Conduct sulfuration; The temperature is controlled within 180° C.±5° C.; Keep for 35 min.;

Step six, Open the mould to take down the insulator; Stick the connector onto the two ends of the hollow insulating tube 2.

MANUFACTURING EXAMPLE 3

Material: methyl ethenyl silicon rubber 30%, white carbon black 40%, aluminum hydroxide 26%, silicone oil 3%, vulcanizing agent 1%.

Process:

Step one, Make hollow insulating tube 2 by winding epoxy glass fiber,

Step two, Put a closely-attached steel pipe at the center of insulating tube 2. Then, put it in the mould in rubber injection machine; Conduct positioning then close the mould;

Step three, Apply a certain pressure 3000 t onto rubber injection machine and lock the mould;

Step four, The injection machine starts to inject the rubber at three spots synchronistically. The rubber injection pressure is 1800 bar. The integrated petticoat is outside the hollow insulating tube 2;

Step five, Conduct sulfuration; The temperature is controlled within 155° C.±5° C.; Keep for 60 min;

Step six, Open the mould to take down the insulator; After correction, stick the connector onto the two ends of the hollow insulating tube 2.

The invention claimed is:

1. A compound and hollow insulator comprising: a connector, an insulating tube and at least two petticoats, the insulating tube being a hollow one made by winding epoxy glass fiber, the connector being fixed at the two ends of the insulating tube; wherein the at least two petticoats are made of a material comprising a high-temperature silicon sulfide rubber and, wherein the at least two petticoats are integrated outside the insulating tube.

2. The compound and hollow insulator according to claim 1, wherein the at least two petticoats are manufactured by integratively injecting high-temperature silicon sulfide rubber.

3. The compound and hollow insulator according to claim 1, wherein the high-temperature silicon sulfide rubber comprises methyl ethenyl silicon rubber, white carbon black, aluminum hydroxide, silicone oil and a vulcanizing agent.

4. The compound and hollow insulator according to claim 3, wherein the high-temperature silicon sulfide rubber comprises: methyl ethenyl silicon rubber present in an amount ranging from about 20% to about 50%, white carbon black present in an amount ranging from about 20% to about 60%, aluminum hydroxide present in an amount ranging from about 25% to about 50%, silicone oil present in an amount ranging from about 2% to about 5% and the vulcanizing agent present in an amount less than about 1%.

5. A manufacturing method for a compound and hollow insulator comprising:

making a hollow insulating tube by winding epoxy glass fiber;

putting the hollow insulating tube in a petticoat mould which is placed in a rubber injection machine; closing the mould;

applying pressure onto the rubber injection machine and locking the mould;

injecting the rubber by the injection machine, wherein an integrated petticoat is outside the hollow insulating tube;

conducting sulfuration; wherein the temperature is controlled within a range from about 150° C. (degrees centigrade) to about 190° C. (degrees centigrade) for a period of time ranging from 20 to 60 minutes;

opening the mould to take down the insulator and sticking the connector onto the two ends of the hollow insulating tube.

6. The manufacturing method for a compound and hollow insulator according to claim 5, comprising, after the making step, applying a layer of adhesive outside the external surface of the hollow insulating tube.

7. The manufacturing method for a compound and hollow insulator according to claim 5, further comprising placing an inner core in the hollow insulating tube.

8. The manufacturing method for a compound and hollow insulator according to claim 7, wherein the inner core is made of steel pipe.

9. The manufacturing method for a compound and hollow insulator according to claim 5, further comprising performing rubber injection at evenly-distributed multi-spots synchronistically and keeping the pressure on the spots of the hollow insulating tube even.

10. The manufacturing method for a compound and hollow insulator according to claim 5, wherein the mould lock pressure ranges from about 500 tons to about 3000 tons and rubber injection pressure ranges from about 1200 bar to about 8000 bar.

11. The rubber injection machine according to claim 10, wherein the rubber injection machine is equipped with a rubber cold flow passage device.

12. The rubber injection machine according to claim 10, wherein the rubber injection machine is equipped with a mould vacuumizing device.

13. The rubber injection machine according to claim 10, wherein the rubber injection machine is equipped with an inner core positioning device.

* * * * *